US007731273B2

(12) United States Patent
Hagele et al.

(10) Patent No.: US 7,731,273 B2
(45) Date of Patent: Jun. 8, 2010

(54) WORK VEHICLE VIEWING SYSTEM

(75) Inventors: Carl Joseph Hagele, Chicago, IL (US); Michael David Case, Kechi, KS (US); Mark W. DeSmit, Jr., Clinton, IA (US); Christohper Dixon Bell, Davenport, IA (US); Kyle Brenner, Silvis, IL (US)

(73) Assignee: CNH America LLC, New Holland, PA (US)

( * ) Notice: Subject to any disclaimer, the term of this patent is extended or adjusted under 35 U.S.C. 154(b) by 238 days.

(21) Appl. No.: 12/023,278

(22) Filed: Jan. 31, 2008

(65) Prior Publication Data

US 2009/0195021 A1 Aug. 6, 2009

(51) Int. Cl.
*B60J 7/00* (2006.01)

(52) U.S. Cl. ..... 296/190.1; 296/190.08

(58) Field of Classification Search ..... 296/190.1, 296/193.03, 165, 190.04, 190.08, 190.11; 180/89.12, 756, 89.13; 285/334
See application file for complete search history.

(56) References Cited

U.S. PATENT DOCUMENTS

| | | | | |
|---|---|---|---|---|
| 3,336,074 | A | 8/1967 | Barnes et al. | |
| 3,690,720 | A * | 9/1972 | Whisler | 296/190.03 |
| 4,119,340 | A * | 10/1978 | Wolfe | 296/190.1 |
| 4,679,847 | A | 7/1987 | Dirck | |
| D427,612 | S * | 7/2000 | Shim | D15/23 |
| D438,878 | S * | 3/2001 | Brandenburg et al. | D15/30 |
| 6,220,656 | B1 | 4/2001 | Martin, Jr. | |
| 6,244,369 | B1 * | 6/2001 | Yunoue et al. | 180/89.12 |
| D463,807 | S * | 10/2002 | Tamaru et al. | D15/30 |
| D471,213 | S | 3/2003 | Kwak et al. | |
| 6,561,572 | B1 | 5/2003 | Martin, Jr. | |
| 6,688,682 | B2 * | 2/2004 | Arthur et al. | 296/16.02 |
| 6,752,228 | B2 | 6/2004 | Aoyama et al. | |
| D494,986 | S | 8/2004 | Tokach et al. | |
| 6,769,732 | B2 * | 8/2004 | Sakyo | 296/190.03 |
| D523,875 | S * | 6/2006 | Kim | D15/30 |
| 7,131,686 | B1 | 11/2006 | Jo et al. | |
| D544,889 | S | 6/2007 | Milburn, Jr. et al. | |
| 7,246,846 | B2 * | 7/2007 | Shioji et al. | 296/190.11 |
| D549,742 | S * | 8/2007 | Koss | D15/30 |
| 7,252,325 | B2 * | 8/2007 | Richards et al. | 296/190.08 |
| 7,290,829 | B2 * | 11/2007 | Umemoto et al. | 296/190.08 |
| D577,040 | S * | 9/2008 | Kim | D15/30 |
| 7,472,945 | B2 * | 1/2009 | Miura | 296/190.03 |
| D607,904 | S * | 1/2010 | Reisenauer et al. | D15/30 |
| 2007/0145780 | A1 * | 6/2007 | Tecklenburg et al. | 296/190.08 |
| 2009/0195024 | A1 * | 8/2009 | Cott et al. | 296/190.08 |

FOREIGN PATENT DOCUMENTS

| | | | |
|---|---|---|---|
| JP | 02216375 | A | 8/1990 |
| JP | 03070686 | A | 3/1991 |
| JP | 2001233151 | A | 8/2001 |

* cited by examiner

*Primary Examiner*—Kiran B. Patel
(74) *Attorney, Agent, or Firm*—Michael J. Harms; John William Stader; Patrick M. Sheldrake

(57) ABSTRACT

A work vehicle is provided including a frame structurally carrying a cab structure having a brim including a plurality of viewing openings. The cab structure structurally carries a window in close proximity to the brim and is disposed above an operating viewing position. The window and brim are in viewing alignment from the operating viewing position. The window is sufficiently disposed within the cab structure for protection from vertically falling objects.

9 Claims, 7 Drawing Sheets

WORK VEHICLE VIEWING SYSTEM

FIELD OF THE INVENTION

The present invention relates generally to the field of work vehicles. It relates more particularly to work vehicles having operator cabs.

SUMMARY OF THE INVENTION

The present invention relates to a work vehicle including a frame supporting a cab structure having a brim including a plurality of viewing openings. The cab structure includes a window in close proximity to the brim and disposed above an operating viewing position, the window and brim in viewing alignment from the operating viewing position. The cab structure is configured to protect the window from vertically falling objects The present invention further relates to a viewing system for a work vehicle including a frame supporting a cab structure. The system includes the cab structure having a brim including a plurality of viewing openings, the cab structure including a window in close proximity to the brim and disposed above an operating viewing position. The window and brim are in viewing alignment from the operating viewing position, the window disposed along a junction between a roof and a wall of the cab structure. The cab structure is configured to protect the window from vertically falling objects The present invention further relates to a method of providing increased operator visibility for a work vehicle. The method includes providing a work vehicle including a frame supporting a cab structure and installing a brim onto the cab structure, the brim including a plurality of viewing openings. The method further includes installing a window in the cab structure in close proximity to the brim and disposed above an operating viewing position, the window and brim in viewing alignment from the operating viewing position. The cab structure is configured to protect the window from vertically falling objects.

An advantage of the present invention is increased visibility for an operator of a work vehicle having a cab structure.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
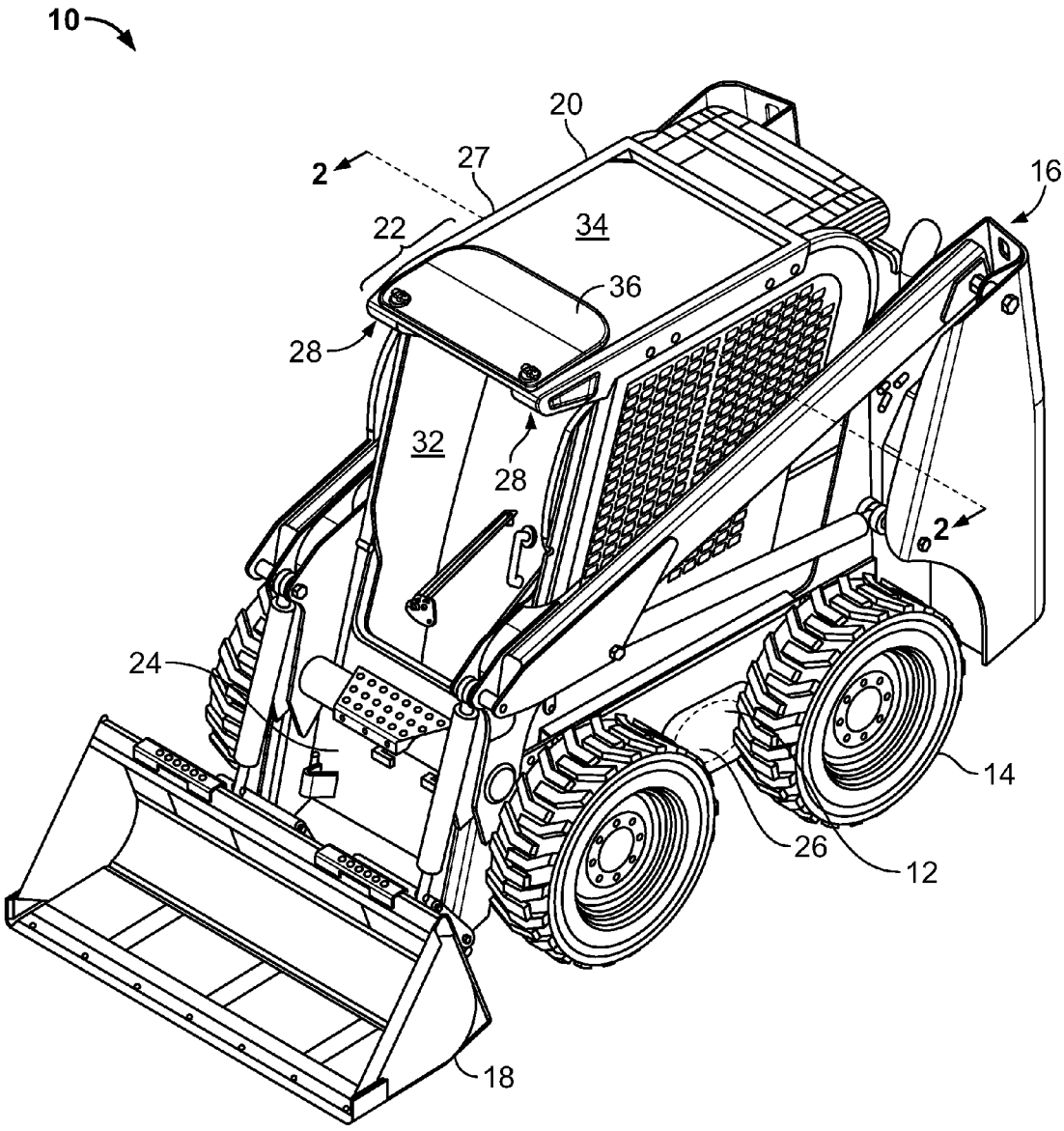
FIG. 1 is a top perspective view of an embodiment of a work vehicle of the present invention.

FIG. 1 shows a work vehicle 10 provided with a frame 12 that rotatably carries a plurality of wheels 14. A lifting structure 16 includes an arrangement of structural members and actuators controllable by an operator (not shown) to manipulate an implement 18 to perform work. Frame 12 structurally supports a cab structure 20 to surround and protect the operator, which frame 12 includes a front end 24 facing implement 18, with front end 24 disposed between opposed sides 26, 27. As further shown in FIG. 1, cab structure 20 includes a brim 22 protruding toward end 24, although in an alternate embodiment, brim 22 or additional brims 22 may extend toward opposed sides 26, 27 or toward the end opposite end 24. In one embodiment, a pair of light assemblies 28 are secured in proximity to opposed sides 26, 27 and also proximate to end 24. Each light assembly 28 provides additional illumination of the surrounding region exterior of work vehicle 10, permitting an operator (not shown) to more safely operate work vehicle 10. As will be discussed in further detail below, a window 30 (FIG. 2) in combination with brim 22 provides a viewing system in viewing alignment from an operating viewing position 54 (FIG. 4) to further enhance operating safety. For purposes herein, operating viewing position 54 is intended to refer to a viewing vantage point of an operator while operating a work vehicle.

Figure 2:
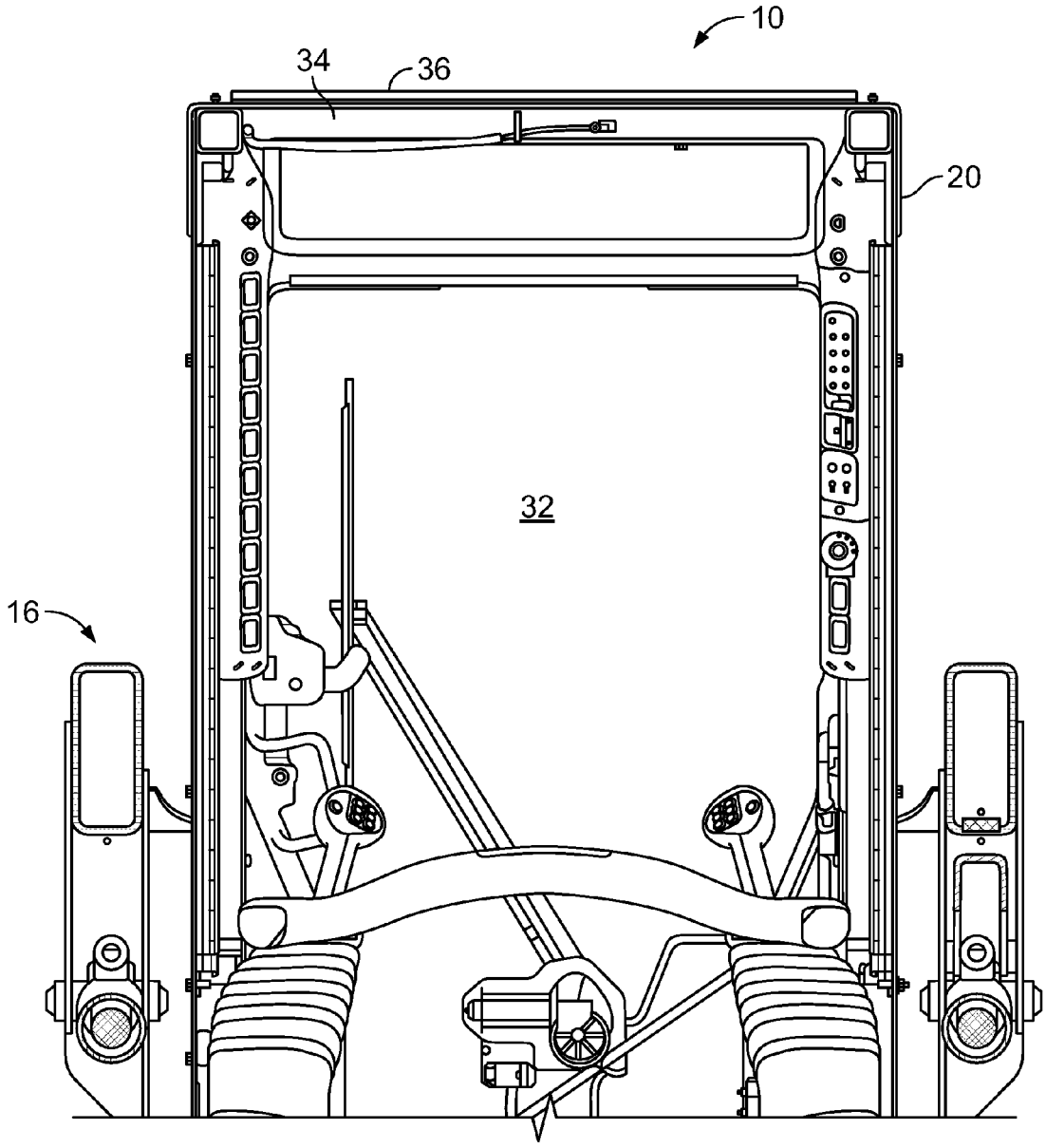
FIG. 2 is an enlarged, partial cross-section taken along line 2-2 of FIG. 1 of the present invention.
Figure 3:
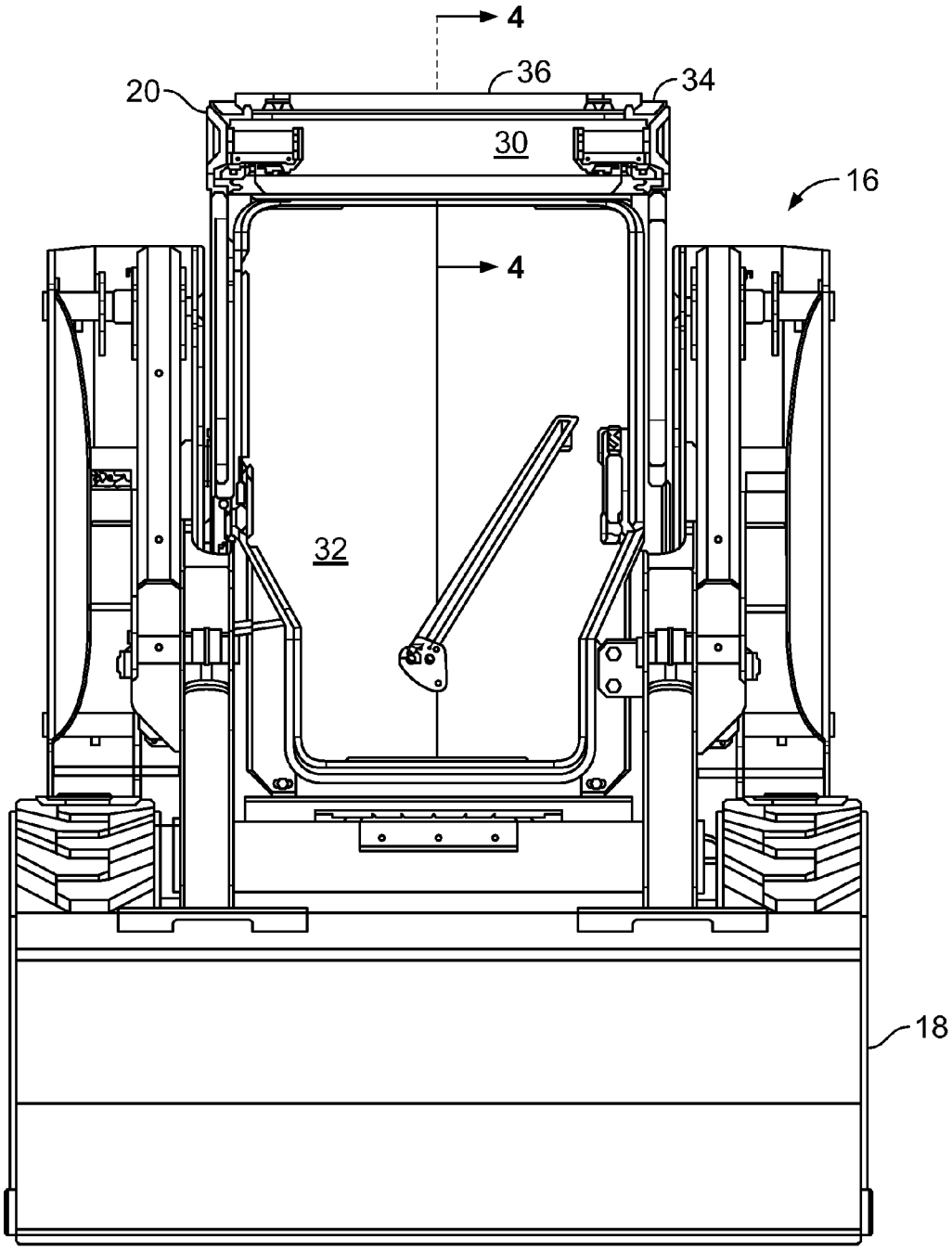
FIG. 3 is a front view of an embodiment of a work vehicle of the present invention.
Figure 4:
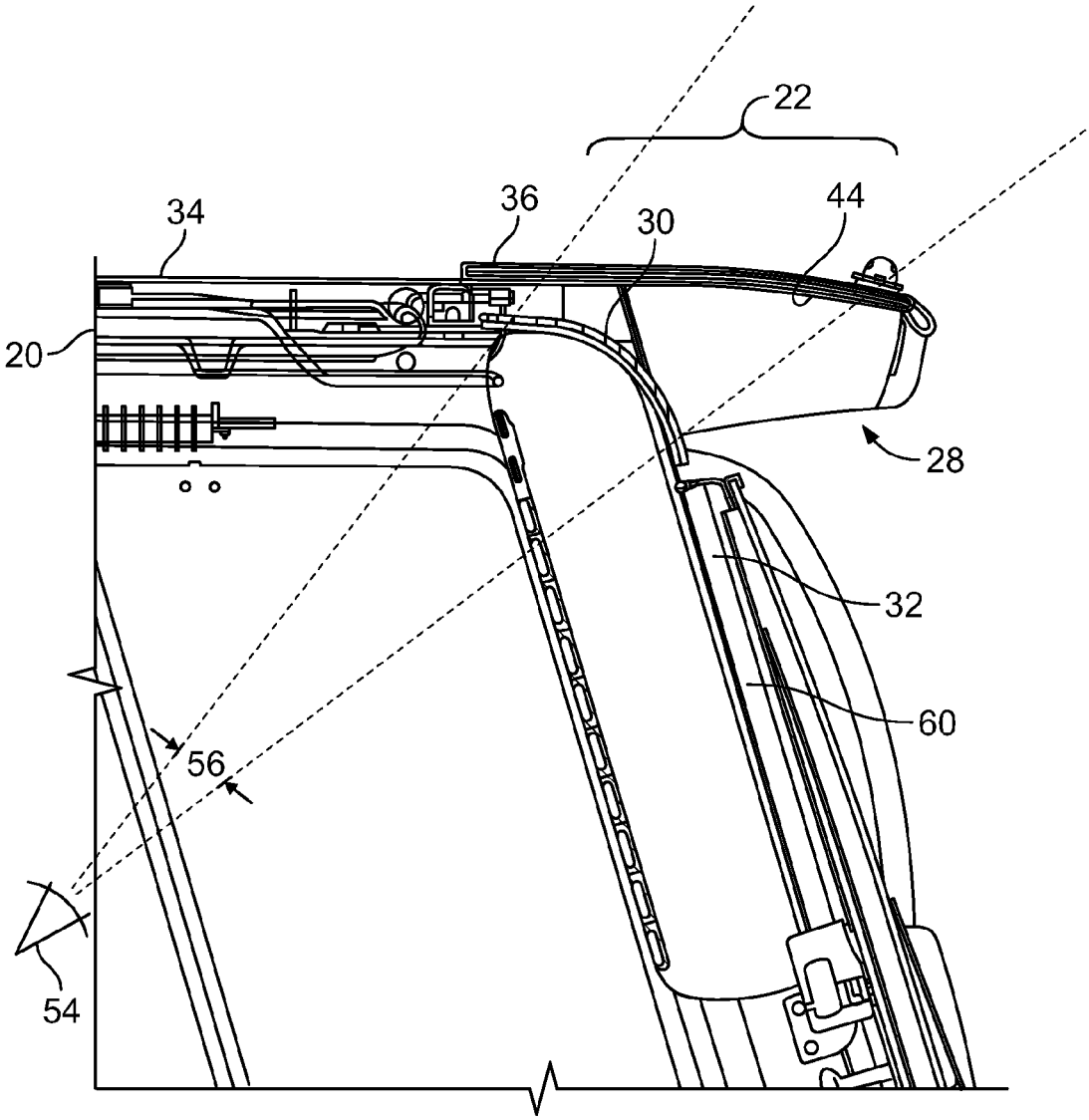
FIG. 4 is an enlarged, partial cross-section taken along line 4-4 of FIG. 3 of the present invention.
Figure 7:
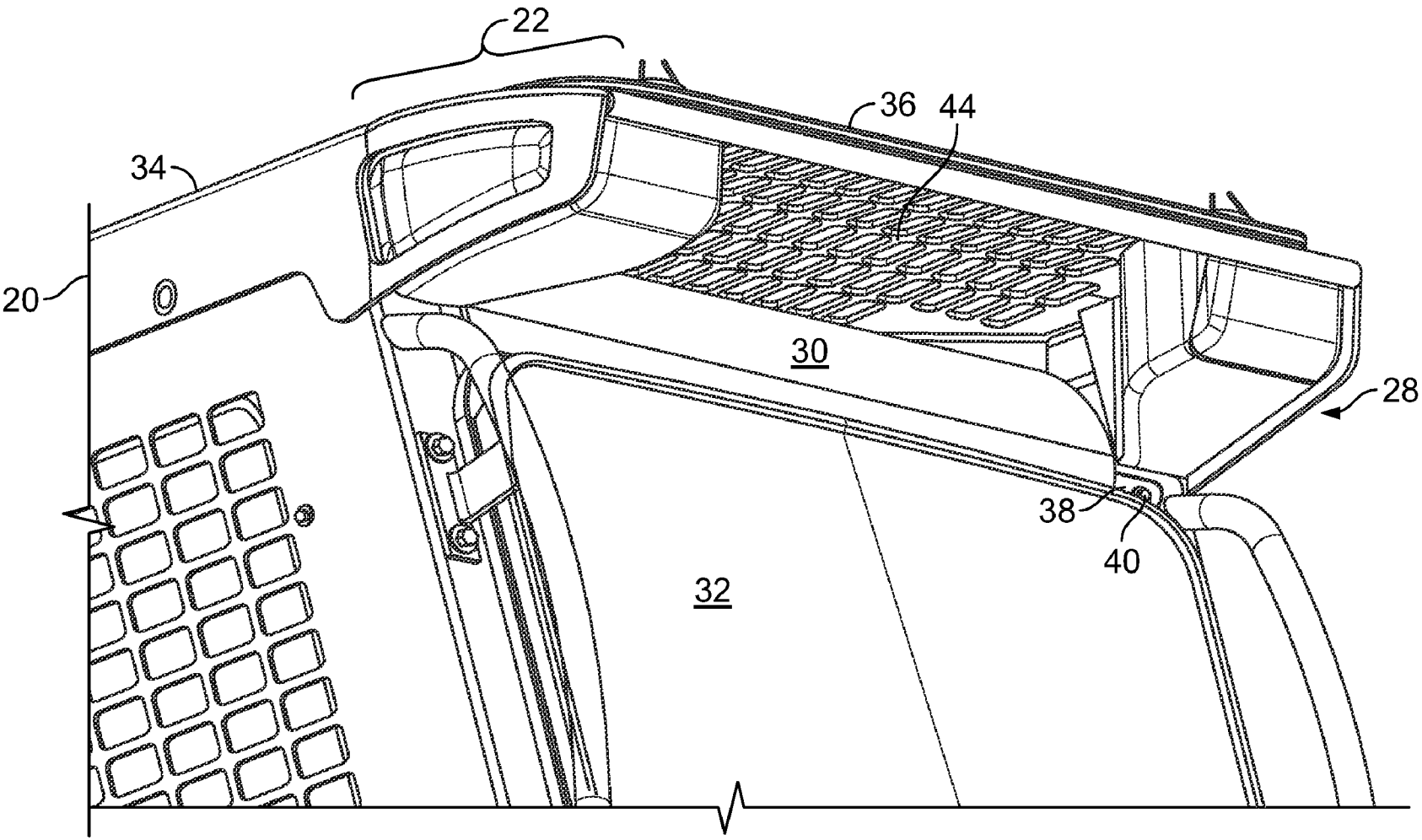
FIG. 7 is an enlarged partial bottom perspective view of an upper portion of an embodiment of a work vehicle cab structure of the present invention.

FIG. 2, which is taken along line 2-2 of FIG. 1, provides a forward-looking viewing vantage point from interior of the cab structure 20 of work vehicle 10. It is appreciated by those having ordinary skill in the art that inclusion of window 30 provides the operator (not shown) with enhanced viewing, such as the ability to view implement 18 (FIG. 1) when implement 18 is raised to its highest position. FIG. 3, which is a front view, shows window 30 and the substantially increased viewing area made available to the operator. FIG. 4, which is an enlarged partial cross-sectional view taken along line 4-4 of FIG. 3, shows operating viewing position 54, as well as a viewing range 56 made possible by window 30. It is apparent from FIG. 4 that viewing openings 44, better shown in FIG. 7, provide virtually unobstructed viewing through brim 22. In one embodiment, viewing openings 44 are arranged to form a lattice.

Figure 5:
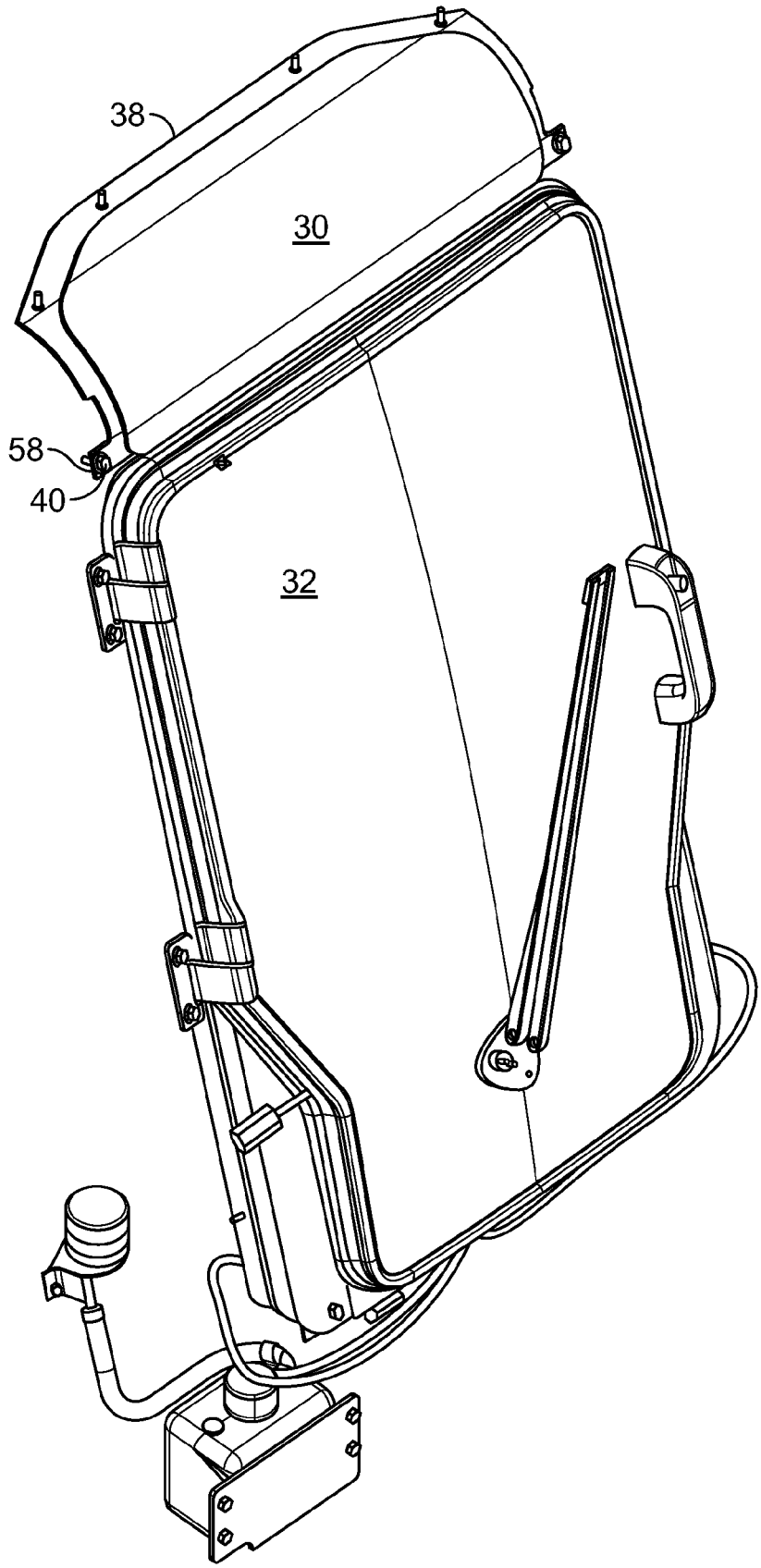
FIG. 5 is a top perspective view of an embodiment of a door and window of the present invention.

As shown in FIG. 5, one embodiment of window 30 includes a frame 38 having corresponding slots or openings 58 for receiving fasteners 40 to secure window 30 to cab structure 20 (FIG. 4). In one embodiment, as shown in FIG. 4, a wall 60 is disposed below window 30. As further shown in FIG. 4, wall 60 includes a door 32 pivotably connected to cab structure 20 (FIG. 3). In this position, window 30 is disposed along a junction between a roof 34 and wall 60 of the cab structure 20. In a further embodiment, window 30 is curved. Window 30 is composed of a suitable material having enhanced optical qualities while minimizing distortion associated with curvature, such as Lexan®, a registered trademark of General Electric Company, polycarbonate, plastic, glass, metal screen or other suitable material. In one embodiment, window 30 is constructed of a material that polarizes light passing therethrough.

Figure 6:
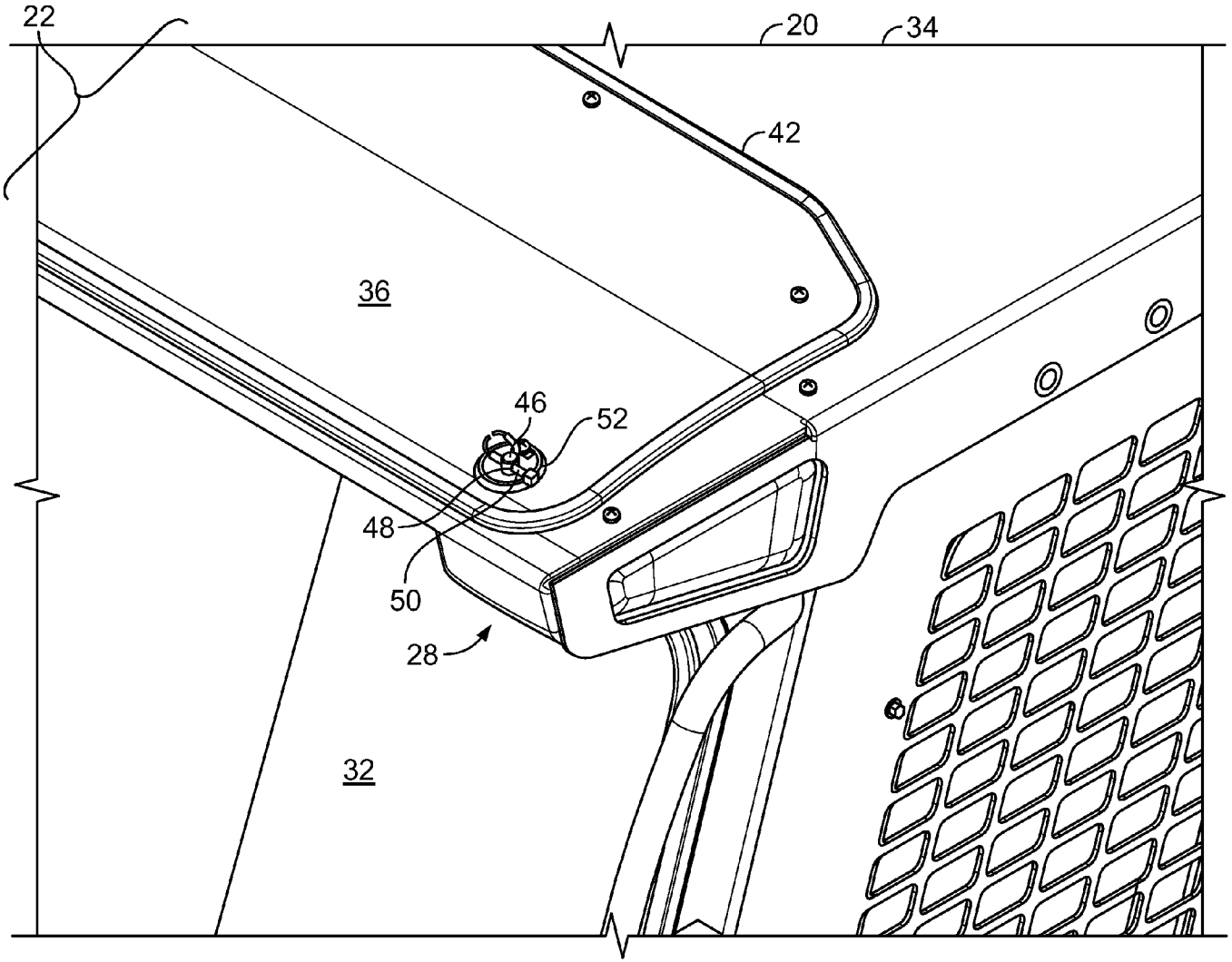
FIG. 6 is an enlarged partial top perspective view of an upper portion of an embodiment of a work vehicle cab structure of the present invention.

As shown in FIGS. 1 and 6, a cover 36 overlies brim 22 to permit passage of light therethrough, and additionally through viewing openings 44 (FIG. 7) formed in brim 22. In one embodiment, cover 36 is contiguous and substantially transparent. In another embodiment, cover 36 is constructed of a material that polarizes light passing therethrough. In one embodiment, brim 22 includes a pair of outwardly extending studs 46 (only one shown in FIG. 6), with each stud 46 received by an opening 48 formed in cover 36. A fastener, such as a pin fastener 50 having a pivoting locking ring 52, commonly referred to as a lynch pin of known construction may be used. In an alternate embodiment, threaded fasteners or fasteners with other retention features many be used. As further shown in FIGS. 1 and 6, cover 36 overlies a substantial portion of brim 22, and in an alternate embodiment, overlies brim 22 virtually in its entirety. In one embodiment, cover 36 includes a border 42 disposed along the perimeter of the cover. Cover 36 helps protect window 30 from vertically falling objects that are sufficiently small to fall through the viewing openings 44 (FIG. 7) formed in brim 22.

It is contemplated that a retrofit kit may be provided for a work vehicle to add a brim 22 having viewing openings 44, cover 36 and window 30, as shown in the FIGS. 1, 6, 7 and described above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A viewing system for a work vehicle including a frame supporting a cab structure, the system comprising the cab structure having a brim including a plurality of viewing openings, the cab structure including a window in close proximity to the brim and disposed above an operating viewing position, the window and brim in viewing alignment from the operating viewing position, the window disposed along a junction between a roof and a wall of the cab structure; and wherein the cab structure is configured to protect the window from vertically falling objects.

2. The system of claim 1, wherein the window is curved.

3. The system of claim 1, wherein the viewing openings form a lattice.

4. The system of claim 3, wherein the lattice is overlain by a contiguous cover.

5. The system of claim 4, wherein the cover permits passage of light therethrough.

6. The work vehicle of claim 5, wherein the cover is substantially transparent.

7. The work vehicle of claim 5, wherein the cover polarizes light passing therethrough.

8. The work vehicle of claim 1, wherein the wall includes a pivotably connected door.

9. The work vehicle of claim 8, wherein the door is disposed below the window.

* * * * *